US009834889B2

(12) United States Patent
Naruko et al.

(10) Patent No.: US 9,834,889 B2
(45) Date of Patent: Dec. 5, 2017

(54) TONER CLEANING SHEET AND METHOD OF MANUFACTURING SAME

(71) Applicant: Toray Industries, Inc., Tokyo (JP)

(72) Inventors: Satoshi Naruko, Otsu (JP); Takashi Kimura, Otsu (JP)

(73) Assignee: Toray Industries, Inc. (JP)

( * ) Notice: Subject to any disclaimer, the term of this patent is extended or adjusted under 35 U.S.C. 154(b) by 0 days.

(21) Appl. No.: 15/107,997

(22) PCT Filed: Dec. 24, 2014

(86) PCT No.: PCT/JP2014/084026

§ 371 (c)(1),
(2) Date: Jun. 24, 2016

(87) PCT Pub. No.: WO2015/098902

PCT Pub. Date: Jul. 2, 2015

(65) Prior Publication Data

US 2016/0319486 A1 Nov. 3, 2016

(30) Foreign Application Priority Data

Dec. 27, 2013 (JP) ..... 2013-270996

(51) Int. Cl.

| | |
|---|---|
| ***D21H 11/00*** | (2006.01) |
| ***D21H 13/20*** | (2006.01) |
| ***G03G 15/20*** | (2006.01) |
| ***G03G 21/00*** | (2006.01) |
| ***D04H 3/009*** | (2012.01) |
| ***D04H 3/14*** | (2012.01) |
| ***D21H 13/12*** | (2006.01) |

(52) U.S. Cl.
CPC ..... *D21H 13/20* (2013.01); *D04H 3/009* (2013.01); *D04H 3/14* (2013.01); *D21H 11/00* (2013.01); *D21H 13/12* (2013.01); *G03G 15/20* (2013.01); *G03G 15/2025* (2013.01); *G03G 21/00* (2013.01)

(58) Field of Classification Search
CPC ..... D21H 11/00; D21H 13/20
USPC ..... 162/146
See application file for complete search history.

(56) References Cited

FOREIGN PATENT DOCUMENTS

| | | | |
|---|---|---|---|
| JP | 05-323819 | A | 12/1993 |
| JP | 07-287496 | A | 10/1995 |
| JP | 10-116011 | A | 5/1998 |
| JP | 2009-028503 | A | 2/2009 |
| JP | 2012-127018 | A | 7/2012 |
| JP | 2012-132992 | A | 7/2012 |
| JP | 2012-211990 | A | 11/2012 |
| JP | 2013-148601 | A | 8/2013 |
| JP | 2014-153654 | A | 8/2014 |
| JP | 2014-222258 | A | 11/2014 |

OTHER PUBLICATIONS

JP 2013 148601, Mitsubishi Paper Mills, Ishida Mariko et al., machine translation, Aug. 2013.*

* cited by examiner

*Primary Examiner* — Mark Halpern
(74) *Attorney, Agent, or Firm* — DLA Piper LLP (US)

(57) ABSTRACT

A toner cleaning sheet includes at least one type of fiber selected from among different thermoplastic fibers formed of thermoplastic resin with a melting point of 265° C. or more and at least one type of fiber selected from among different cellulose fibers, wherein at least part of the aforementioned thermoplastic fiber is fusion-bonded to neighboring thermoplastic fiber filaments. The toner cleaning sheet can be produced by a method that includes at least one type of fiber selected from among different thermoplastic fibers formed of thermoplastic resin with a melting point of 265° C. or more and at least one type of fiber selected from among different cellulose fibers, the method including a bonding step in which at least part of the aforementioned thermoplastic fiber is fusion-bonded to neighboring thermoplastic fiber filaments.

10 Claims, 1 Drawing Sheet

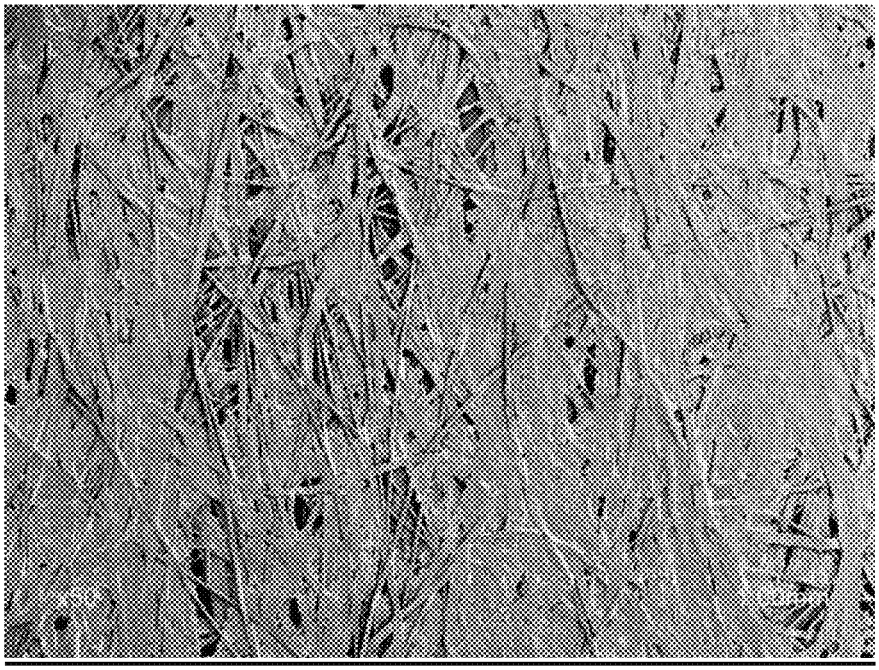

TONER CLEANING SHEET AND METHOD OF MANUFACTURING SAME

This application is a 371 of PCT/JP2014/084026 filed 24 Dec. 2014.

TECHNICAL FIELD

This disclosure relates to a toner cleaning sheet for the removal of toner remaining in the fixing belt in a copying machine or the like and a production method therefor.

BACKGROUND

Conventionally, in copying machines and the like that use an electrophotographic method, an electrostatic latent image is formed on a photosensitive drum, followed by converting the resulting latent image into a toner image, transferring the toner image to a transfer material such as paper, and fixing the toner on the material such as paper by applying heat, pressure, or the like to obtain a copy or record image.

In such copying machines and the like, a toner image formed by development on the photosensitive drum is transferred onto transfer material and then the transfer material carrying the toner image is passed between a fixing roller and a pressure roller pressed against each other while rotating so that the toner image is fusion-bonded to the transfer material by the effect of the heat and pressure of the fixing roller.

The above fixing roller is equipped with a fixing belt and this fixing belt can suffer the adhesion of residual toner left unfixed on the transfer material or powder of the paper used as transfer material, possibly causing failure in the fixing of a new toner image. Therefore, it is necessary to perform continuous cleaning to remove the toner and paper powder adhered on the fixing belt. If not equipped with a fixing belt, the fixing roller has to be cleaned continuously to remove the adhered toner and paper powder as described above.

A method of removing toner or the like such as described above is to supply a toner cleaning sheet such as nonwoven fabric wound into a roll and allow the sheet and the fixing belt to pass together between a toner cleaning heating roller and a pressure roller to heat them under pressure so that the toner and paper powder adhered on the fixing belt are transferred to the sheet, thereby removing the toner and the like from the fixing belt.

Useful materials for the toner cleaning sheet include woven fabrics, knitted fabrics, and nonwoven fabrics formed of polyester fiber, nylon fiber, cellulose fiber, polyethylene fiber, polypropylene fiber, rayon fiber, vinylon fiber, pulp fiber or the like (see Japanese Unexamined Patent Publication (Kokai) No. HEI 10-116011).

In this case, the toner cleaning heating roller is usually operated at a temperature about 180° C. to 200° C. and, accordingly, the toner cleaning sheet has to be resistant to a temperature at around 180° C. to 200° C. Moreover, when a copying machine is activated from the standby state to the functional state for printing, the temperature of the toner cleaning heating roller may exceed (i.e., overshoot) the specified temperature momentarily and reach about 230° C. as it has to be increased very rapidly. Therefore, the toner cleaning sheet is required to retain strength to resist instantaneous heating up to a temperature about 230° C. Furthermore, the copying machine should be high in cleaning performance because if cleaning performance is high for this operation, it serves to shorten the length of the toner cleaning sheet to be installed in the copying machine, thus enabling space saving (i.e., reduction in copying machine size).

On the other hand, a paper product that contains polyphenylene sulfide fiber has been proposed as a material for sheets with increased heat resistance (see Japanese Unexamined Patent Publication (Kokai) No. 2012-127018).

In addition to the above sheet, another toner cleaning sheet that contains aramid fiber has also been proposed (see Japanese Unexamined Patent Publication (Kokai) HEI 7-287496). Aramid fiber is a synthetic fiber composed of amide bonds (—NHOC—) that connect aromatic rings such as benzene rings to form a macromolecular polyamide, which is also called aromatic polyamide. Among others, meta-aramid fiber has high heat resistance.

However, conventional toner cleaning sheets such as the one described in JP '011 are not sufficiently high in heat resistance and cannot be said to show satisfactory performance.

Furthermore, if a PPS fiber based sheet as described in JP '018 is used for toner cleaning, the sheet may be softened as the heating roller for toner cleaning reaches a temperature of about 230° C. as a result of overshooting, causing elongation of the sheet and leading to poor practicality.

In addition, toner cleaning sheets formed of meta-aramid fiber as described in JP '496 are high in cost and have problems related to material availability.

Thus, it could be helpful to provide a toner cleaning sheet high in heat resistance, high in durability with little decrease in tensile break strength under heat even in temperature overshoot in heating rollers for toner cleaning, high in cleaning performance, and low in price.

SUMMARY

We provide a method that produces a toner cleaning sheet including at least one type of fiber selected from among different thermoplastic fibers formed of thermoplastic resin with a melting point of 265° C. or more and at least one type of fiber selected from among different cellulose fibers and that includes a step of fusing at least part of the thermoplastic fiber and bonding it with neighboring thermoplastic fiber filaments.

The method may include a fiber web formation step in which the aforementioned at least one type of fiber selected from among different thermoplastic fibers formed of thermoplastic resin with a melting point of 265° C. or more and at least one type of fiber selected from among different cellulose fibers are arranged in thin layers to form a fiber web, followed by a bonding step as described above.

The toner cleaning sheet production that includes the aforementioned fiber web formation step and bonding step may be carried out by the wet paper making technique.

The method may include a wet-laid nonwoven fabric formation step carried out by the wet paper making technique and a subsequent step of subjecting the resulting wet-laid nonwoven fabric to heating under pressure.

The aforementioned formation of wet-laid nonwoven fabric may include a step of forming thermoplastic fiber slurry containing at least one type of fiber selected from among different thermoplastic fibers formed of thermoplastic resin with a melting point of 265° C. or more, that is dispersed in water, a step of forming a cellulose fiber slurry containing at least one type of fiber selected from among different cellulose fibers, that is dispersed in water, a step of forming a mixture slurry by mixing the aforementioned two types of slurry, a step of forming paper from the aforementioned mixture slurry in a papermaking machine, and a subsequent step of drying it to provide wet-laid nonwoven fabric.

The aforementioned heating under pressure may be carried out by subjecting the aforementioned wet-laid nonwoven fabric to heating under pressure in a calendering and/or hot pressing machine.

Furthermore, the toner cleaning sheet comprises at least one type of fiber selected from among different thermoplastic fibers formed of thermoplastic resin with a melting point of 265° C. or more and at least one type of fiber selected from among different cellulose fibers, wherein at least part of the aforementioned thermoplastic fiber is fusion-bonded to neighboring thermoplastic fiber filaments.

The aforementioned cellulose fiber may be wood pulp fiber.

The aforementioned thermoplastic fiber may contain both stretched and unstretched filaments.

The aforementioned stretched filaments may be stretched polyphenylene sulfide filaments and the aforementioned unstretched filaments may be unstretched polyphenylene sulfide filaments.

The content ratio between the aforementioned at least one type of fiber selected from among different thermoplastic fibers and the aforementioned at least one type of fiber selected from among different cellulose fibers may be 8:2 to 2:8 by mass.

The content ratio between the aforementioned stretched polyphenylene sulfide filaments and the aforementioned unstretched polyphenylene sulfide filaments may be 7:3 to 3:7 by mass.

We provide a toner cleaning sheet that has long-term heat resistance at service environment temperatures (180° C. to 200° C.) and heat resistance to momentary high temperature heating (230° C.) attributed to temperature overshoot in the heating roller for toner cleaning and that also ensures high cleaning performance, low prices, and stable supply.

BRIEF DESCRIPTION OF THE DRAWING

FIG. 1 is a photograph that schematically shows features of our toner cleaning sheet.

DETAILED DESCRIPTION

The toner cleaning sheet comprises at least one type of fiber selected from among different thermoplastic fibers formed of thermoplastic resin with a melting point of 265° C. or more and at least one type of fiber selected from among different cellulose fibers, wherein at least part of the aforementioned thermoplastic fiber is fusion-bonded to neighboring fiber filaments.

Thermoplastic fiber formed of thermoplastic resin with a melting point of 265° C. or more has a sufficiently high melting point as compared with the service environment temperature range of 180° C. to 200° C. of the toner cleaning sheet and maintains a sufficiently large working strength even when exposed for a long term to the service environment temperature of the toner cleaning sheet. A melting point of 265° C. or more is sufficiently high, but as the material and production costs tend to increase with the melting point, a melting point of 350° C. will be a practical limit for the thermoplastic resin used to constitute the thermoplastic fiber.

The melting point is measured by differential scanning calorimetry and the measurement taken during the second heating run is adopted as the melting point. Specifically, a sample of fiber contained in a differential scanning calorimeter (for example, DSC-60 manufactured by Shimadzu Corporation) is heated in a nitrogen atmosphere from 20° C. to 320° C. at a heating rate of 10° C./min and then quenched with liquid nitrogen, followed by heating again in a nitrogen atmosphere from 20° C. to 320° C. at a heating rate of 10° C./min. The temperature of the main endothermic peak observed during the second heating run is measured and adopted as the melting point.

The thermoplastic fiber formed of thermoplastic resin with a melting point of 265° C. or more is preferably one selected from, for example, polyphenylene sulfide fiber (hereinafter occasionally referred to as PPS fiber, melting point 285° C.), polytetrafluoroethylene fiber (hereinafter occasionally referred to as PTFE fiber, melting point 327° C.), ethylene-tetrafluoroethylene copolymer fiber (hereinafter occasionally referred to as ETFE fiber, melting point 270° C.), liquid crystal polyester fiber (hereinafter occasionally referred to as LCP fiber), polyethylene naphthalate fiber (hereinafter occasionally referred to as PEN fiber, melting point 269° C.), polyether ether ketone fiber (hereinafter occasionally referred to as PEEK fiber, melting point 334° C.), and triacetate fiber, which may be used singly or in combination. It is preferable to use PPS fiber because of its particularly high strength and heat resistance.

Commercially available PPS fiber products include TORCON (registered trademark) manufactured by Toray Industries, Inc.; PTFE fiber products include Toyoflon (registered trademark) manufactured by Toray Industries, Inc.; ETFE fiber products include those manufactured by Kureha Gohsen Co., Ltd.; LCP fiber products include Zxion (registered trademark) manufactured by KB Seiren, Ltd.; and PEN fiber products include Teonex (registered trademark) manufactured by Teijin Limited. All of these commercial products can be used.

A sheet with high cleaning performance can be obtained because at least part of the thermoplastic fiber is fused and bonded with neighboring thermoplastic fiber filaments to increase the strength of the sheet and make the sheet surface smooth as a result of the fused thermoplastic fiber filling the gaps among fiber filaments, leading to an increased area of contact with the fixing belt during cleaning. In the state where part of the fiber is fused, the original form of the fiber may remain after fusion or the original form of the fiber may not remain due to deformation of the entire fiber by fusion.

FIG. 1 is a photograph that schematically illustrates in features of the toner cleaning sheet and shows a state where at least part of the thermoplastic fiber is fused and bonded with neighboring thermoplastic fiber filaments.

To develop this state that contains thermoplastic fiber formed of thermoplastic resin with a melting point of 265° C. or more with part of the thermoplastic fiber fused and bonded with neighboring thermoplastic fiber filaments, cellulose fiber and thermoplastic fiber may be mixed to form a sheet, followed by heating it under pressure at a temperature where the thermoplastic fiber is fused.

Furthermore, the toner cleaning sheet contains cellulose fiber and, since this cellulose fiber is non-meltable and high in momentary heat resistance and dimensional stability, the combined use with the aforementioned thermoplastic fiber serves to maintain a sufficiently high strength even when the service environment temperature is exceeded due to temperature overshoot in the heating roller.

The content ratio between the thermoplastic fiber and cellulose fiber is preferably 9:1 to 1:9 by mass, more preferably 8:2 to 2:8, still more preferably 7:3 to 3:7. Use of the thermoplastic fiber in such a proportional range is preferable because the cellulose fiber can work effectively to prevent a decrease in tensile break strength under heat, thereby serving to provide a highly heat resistant toner cleaning sheet at practically reasonable costs.

Different types of cellulose fiber are roughly divided into natural and regenerated fibers, but both can be used. These cellulose fibers are generally non-meltable and will not be softened by heating. The cellulose fibers are also high in dimensional stability and, if used in combination with thermoplastic fiber, serve to produce a sheet with increased heat resistance.

Natural fibers as described above include, for example, wood pulps such as kraft pulp, mechanical pulp, and recycled pulp, and non-wood pulps such as sisal hemp, Manila hemp, sugar cane, cotton, silk, bamboo, and kenaf. Of these, it is preferable to use wood pulp because of good physical properties such as paper durability and dimensional stability, as well as high availability and low prices.

In using wood pulps, different kraft pulps are available including, for example, bleached kraft pulps such as needle-leaved tree bleached kraft pulp and broad-leaved tree bleached kraft pulp, unbleached kraft pulps such as needle-leaved tree unbleached kraft pulp and broad-leaved tree unbleached kraft pulp, half-bleached kraft pulps such as needle-leaved tree half-bleached kraft pulp and broad-leaved tree half-bleached kraft pulp, and sulfite kraft pulps such as needle-leaved tree sulfite kraft pulp and broad-leaved tree sulfite kraft pulp.

Different mechanical pulps are also available including, for example, stone groundwood pulp, compressed stone groundwood pulp, refiner groundwood pulp, chemiground pulp, thermogroundwood pulp, groundwood pulp, thermomechanical pulp, chemithermomechanical pulp, and refiner mechanical pulp.

Different recycled pulps are available including disaggregated recycled pulp, deinked recycled pulp, disaggregated deinked recycled pulp, and deinked bleached recycled pulp produced from such materials as waste newspaper, waste magazines, waste corrugated board, waste kraft paper, waste kraft envelopes, waste flier paper, waste office paper, waste high-quality white paper, waste Kent paper, waste structural paper, and waste pasteboard.

Thus, various types of wood pulp can be used in different examples, but kraft pulp is particularly preferable because it is free of rigid resin such as lignin, making the fiber soft.

When using kraft pulp, either needle-leaved tree kraft pulp or broad-leaved tree kraft pulp may be used singly or both of them may be used as a mixture.

Containing softer and longer fibers than broad-leaved tree kraft pulp, needle-leaved tree kraft pulp is characterized by effective fiber entanglement and preferred to produce high-strength paper due to effective entanglement with other fibers. Broad-leaved tree kraft pulp, on the other hand, is inferior to needle-leaved tree kraft pulp in terms of entanglement with other fibers due to shorter fiber length, but works effectively to fill the gaps among fiber filaments and enhance the filament yield, thereby improving the cleaning performance.

Regenerated fibers include, for example, those of rayon, polynosic, cupra, or lyocell. Commercially available regenerated fiber products include rayon fiber manufactured by Daiwabo Rayon Co., Ltd. and Bemberg (registered trademark) cupra fiber manufactured by Asahi Kasei Corporation.

It is preferable for the aforementioned thermoplastic fiber to contain both stretched and unstretched filaments. Stretched filaments are high in degree of crystallinity and difficult to soften by heating under pressure, but high in heat resistance and generally high in strength.

To stretch filaments, the tensile strength to be used should be as high as possible and, for example, it is preferably 2 to 10 N/dtex, more preferably 3 to 10 N/dtex.

Unstretched filaments, on the other hand, are low in degree of crystallinity and easy to soften by heating under pressure to allow them to bond to neighboring fiber filaments, making it possible to produce sheets having smooth surfaces and showing high cleaning performance. For these reasons, a larger content of stretched filaments ensures improved heat resistance whereas a larger content of unstretched filaments ensures improved cleaning performance. Accordingly, the mass ratio between stretched filaments and unstretched filaments is preferably 9:1 to 1:9, more preferably 8:2 to 2:8, still more preferably 3:7 to 7:3.

Unstretched filaments generally soften at lower temperatures than stretched filaments and accordingly, mixing stretched filaments and unstretched filaments and heating them under pressure at a temperature where the unstretched filaments can fuse while the stretched filaments do not soften will allow only the unstretched filaments to soften and bond to neighboring fiber filaments, enabling the production of a sheet having both high heat resistance and high cleaning performance.

The stretched filaments and the unstretched filaments may originate from different thermoplastic resins, but from the viewpoint of fusion bonding treatment, it is preferable for them to have an identical backbone.

It is preferable from the viewpoint of heat resistance for the aforementioned thermoplastic fiber to be PPS fiber and for this reason, it is preferable that the stretched filaments be stretched polyphenylene sulfide filaments and that the unstretched filaments be unstretched polyphenylene sulfide filaments.

PPS fiber is a highly heat resistant synthetic fiber formed from a polymer containing ($—C_6H_4—S—$) as the main polymer structural unit. Major examples of the PPS polymer include polyphenylene sulfide, polyphenylene sulfide sulfone, polyphenylene sulfide ketone, random copolymers thereof, block copolymers thereof, and mixtures thereof In the next place, methods of producing the toner cleaning sheet will be described.

Method of Producing Sheets

The production method for the toner cleaning sheet consists mainly of a stage for arranging thin fiber in a film shape to form fiber webs and a stage for bonding the fiber webs thus formed.

Available techniques for fiber web formation include, for example, the carding technique, that mechanically combs fiber into a web, the air layering technique designed for web formation in a random manner by using air flows, the spunbonding technique that continuously discharges molten thermoplastic polymer to form a web, the meltblowing technique, which is a modified form of spunbonding designed to form a thin fiber web by applying high temperature air flows, and the wet papermaking technique that applies a papermaking process to water containing very short fibers.

Of these, the wet papermaking technique is preferred because it can produce a sheet composed of two or more fiber materials uniformly dispersed and realize good properties distribution and a stable mass per unit area to stably ensure high cleaning performance. The wet papermaking technique serves to provide a sheet with stable, high cleaning performance that is small variation in mass per unit area and has a smooth sheet surface.

To bond the fiber webs thus formed, available techniques include the thermal bonding (heat bonding) technique that uses heat to bond the fiber webs, the resin bonding technique (chemical bonding technique) that performs impregnation, spraying or the like of an adhesive to bond the fiber webs, the needle punching technique that pushes barbed needles through fiber webs to bind them mechanically, and the water jet technique (spunlacing technique) that performs high-pressure water jetting to entangle fibers.

Sheet Production Method using the Wet Papermaking Technique

The preferred toner cleaning sheet production method that uses the wet papermaking technique roughly consists of a step of forming a thermoplastic fiber slurry containing at least one type of fiber selected from among different thermoplastic fibers formed of thermoplastic resin with a melting point of 265° C. or more dispersed in water, a step of forming a cellulose fiber slurry containing at least one type of fiber selected from among different non-meltable cellulose fibers dispersed in water, a step of forming a mixture slurry by mixing the aforementioned two types of slurry, a step of forming paper from the resulting mixture slurry in a papermaking machine, a subsequent step of drying to provide wet-laid nonwoven fabric, and a step of heating the resulting wet-laid nonwoven fabric under pressure using a calendaring machine, hot pressing machine and the like.

Production of Thermoplastic Fiber Slurry

Thermoplastic fiber slurry to be used for the wet papermaking technique is prepared by mixing water with thermoplastic fiber of thermoplastic resin having a melting point of 265° C. or more, wherein the content ratio between the thermoplastic fiber of thermoplastic resin and water is preferably 1:100 to 10:100, more preferably 1:100 to 5:100, particular preferably 1:100 to 2:100, by mass. This thermoplastic fiber slurry may contain a dispersing agent, viscosity adjustor, antifoam agent or the like, as required.

Thermoplastic fiber to be used to form the thermoplastic fiber slurry preferably has a fiber length of 2 to 38 mm, more preferably 2 to 20 mm. A fiber length in the above range allows the fiber to be dispersed more uniformly in a feed liquid for a papermaking machine and the wet-laid nonwoven fabric produced by a papermaking machine will have a sufficiently high tensile strength.

With respect to the thickness, it is preferable for the thermoplastic fiber to have a monofilament fineness of 0.1 to 10.0 dtex so that it can be dispersed uniformly without coagulation in a feed liquid for a papermaking machine. The monofilament fineness is more preferably 0.5 to 10.0 dtex, still more preferably 1.0 to 6.0 dtex.

Cellulose Fiber Slurry

Cellulose fiber slurry is prepared by mixing water with non-meltable cellulose fiber, where the content ratio between the cellulose fiber and water is preferably 1:100 to 10:100, more preferably 1:100 to 5:100, particular preferably 2:100 to 4:100, by mass. This cellulose fiber slurry may contain a dispersing agent, viscosity adjustor, antifoam agent or the like, as required.

Cellulose fiber to be used in cellulose fiber slurry preferably has a fiber length of 1 to 38 mm. A fiber length of 1 to 38 mm allows the fiber to be uniformly dispersed in a feed liquid for a papermaking machine and the wet-laid nonwoven fabric produced by a papermaking machine having a sufficiently high tensile strength. With respect to the thickness, it is preferable for the fiber to have a monofilament fineness of 0.1 to 10.0 dtex so that it can be dispersed uniformly without coagulation in a feed liquid for a papermaking machine. The fiber length is preferably 4 to 20 mm and more preferably 5 to 10 mm.

If natural fiber is used as the cellulose fiber, the natural fiber is generally beaten by a beating machine such as SDR (single disk refiner), DDR (double disk refiner), and Niagara beater, before processing into slurry.

With respect to the degree of beating, the beaten fiber preferably has a Canadian Standard freeness (CSF) of 50 to 600 cc as measured according to JIS P 8121-2 (2012). If the CSF is less than 50 cc, the fiber will be too low in freeness, leading to a low productivity. If the CSF is more than 600 cc, on the other hand, the natural fiber will not be fibrillated sufficiently, possibly leading to a large variation in mass per unit area.

Mixture Slurry

The above thermoplastic fiber slurry and cellulose fiber slurry are mixed and stirred to provide mixture slurry. The thermoplastic fiber slurry and cellulose fiber slurry are mixed at an appropriate ratio, taking into account the required characteristics of the target sheet.

Papermaking Processing

Mixture slurry containing thermoplastic fiber slurry and cellulose fiber slurry is subjected to a papermaking processing to obtain a wet web. Any general type papermaking machine may work without problems. For example, useful papermaking machines include cylinder papermaking machines, Fourdrinier papermaking machines, short-wire papermaking machines, and combinations thereof.

Drying

To remove moisture to dry the resulting wet web, the drier part attached to the papermaking machine may be used and drying may be performed in a step that incorporates a rotating drum type drier such as Yankee dryer and multi-cylinder dryer. Such a rotating drum type machine preferably works at a drying temperature of 90° C. to 130° C. to ensure efficient moisture removal.

Heating Under Pressure

A preferred production method for the toner cleaning sheet is to remove moisture followed by heating under pressure in a calendering machine. A calendering machine has more than one pair of rollers combined with components for heating and pressing. The rollers may be of an appropriately selected material such as metal, paper, and rubber, but metal rollers such as steel rollers are preferred to depress fine fuzzing on the sheet surface.

Heating under pressure is performed under conditions that can fuse at least part of the thermoplastic fiber and bond it to neighboring fiber filaments. Fusion and bonding can be achieved under a low pressure if the roller temperature is high, but a higher pressure is required for fusion and bonding if the rollers are set to a low temperature.

Specific conditions are set appropriately taking into account the type of thermoplastic fiber to be used. When stretched and unstretched PPS filaments are used, for example, the rollers preferably have a surface temperature of 120° C. to 275° C. If the surface temperature is less than 120° C., it will be difficult to achieve fusion and bonding of thermoplastic fiber having a melting point of 265° C. or more. If the surface temperature is more than 275° C., on the other hand, thermoplastic fiber with a melting point of 265° C. or more will suffer large shrinkage, possibly leading to a sheet with poor surface quality.

For the roller pressure, a linear pressure of 100 to 8,000 N/cm is preferably adopted. Adoption of a linear pressure in this range causes fusion and bonding of the thermoplastic fiber with a melting point of 265° C. or more that forms the sheet surface so that the gaps among fiber filaments in the sheet surface will be filled to ensure high surface smoothness and good cleaning performance.

The toner cleaning sheet can serve for various purposes such as those listed in the "Background" section.

EXAMPLES

Features of and production methods for the toner cleaning sheet are described in more detail below with reference to Examples.

Thermoplastic Fiber

PPS fiber with a melting point of 285° C. was used as the thermoplastic fiber with a melting point of 265° C. or more.

Stretched PPS Fiber

The stretched PPS fiber used was TORCON (registered trademark) manufactured by Toray Industries, Inc. (product number S301) having a monofilament fineness of 1.0 dtex and cut to a length of 6 mm.

Unstretched PPS Fiber

The unstretched PPS fiber used was TORCON (registered trademark) manufactured by Toray Industries, Inc. (product number S111) having a monofilament fineness of 3.0 dtex and cut to a length of 6 mm.

Cellulose Fiber

The non-meltable cellulose fiber used was wood pulp fiber produced from chips of Japanese larch that had a fiber length of about 3.0 to 5.0 mm and a width of about 50 μm.

Beating Machine

The machine used to beat the wood pulp fiber was a Niagara beater (manufactured by Kumagai Riki Kogyo Co., Ltd.).

Hand Papermaking Machine

The papermaking machine used was a hand papermaking machine (manufactured by Kumagai Riki Kogyo Co., Ltd.) having a size of 25 cm×25 cm with a height of 40 cm and provided with a 140-mesh hand papermaking net installed at the bottom.

Drying Machine

A rotary drying machine (manufactured by Kumagai Riki Kogyo Co., Ltd.) was used in a step where a wet web prepared by the hand papermaking machine was dried to produce dried paper.

Calendering Machine

A calendering machine (manufactured by Yuri Roll Co., Ltd.) consisting mainly of a metal roll and a paper roll was used in a step where the dried paper was heated under pressure.

Method of Producing Sheets

The aforementioned PPS fiber was mixed with water to a PPS fiber concentration of 0.5 mass% and stirred for 10 seconds by a home-use combination juicer and mixer to prepare PPS fiber slurry. Three PPS fiber slurry samples with a stretched PPS fiber to unstretched PPS fiber ratio by mass of 7:3, 5:5, or 3:7 were prepared.

The aforementioned wood pulp fiber was mixed with water to a wood pulp fiber concentration of 0.5 mass% and beaten to a CSF of 350 cc to prepare cellulose fiber slurry.

These two types of slurry were mixed appropriately at a ratio as given in Table 1 and fed to a hand papermaking machine to produce a sample of about 20 g/m$^2$, followed by adding water to provide 20 L (liters) in total of a dispersion liquid for papermaking, which was then stirred thoroughly.

Water was removed from the hand papermaking machine and the wet web left on the papermaking net transferred onto filter paper. The wet web, together with the filter paper, was put in a rotary drying machine and subjected to a drying step having a temperature of 110° C., step passing speed of 0.5 m/min, and step length of 1.25 m (processing period 2.5 min), which was repeated twice in total, to provide dried paper.

Examples 1 to 10 and Comparative Examples 1 to 5

In Examples 1 to 9 and Comparative Examples 1 to 5, dried paper as produced above was removed from the filter paper and heated under pressure in a calendering machine under the conditions of a temperature of 200° C., a linear pressure of 2,000 N/cm, and a rotating roll speed of 10 m/min to provide sheets as given in Table 1.

In Example 10, dried paper as produced above was removed from the filter paper and heated under pressure in a calendering machine under the conditions of a temperature of 275° C., a linear pressure of 2,000 N/cm, and a rotating roll speed of 10 m/min to provide a sheet as given in Table 1.

TABLE 1

| | Fiber components in sheets | | | |
|---|---|---|---|---|
| | CF:PPS1:PPS2 | CF:(PPS1 + PPS2) | PPS1:PPS2 | Notes |
| Example 1 | 20:56:24 | 20:80 | 70:30 | — |
| Example 2 | 20:40:40 | 20:80 | 50:50 | — |
| Example 3 | 20:24:56 | 20:80 | 30:70 | — |
| Example 4 | 50:35:15 | 50:50 | 70:30 | — |
| Example 5 | 50:25:25 | 50:50 | 50:50 | — |
| Example 6 | 50:15:35 | 50:50 | 30:70 | — |
| Example 7 | 80:14:6 | 80:20 | 70:30 | — |
| Example 8 | 80:10:10 | 80:20 | 50:50 | — |
| Example 9 | 80:6:14 | 80:20 | 30:70 | — |
| Example 10 | 50:50:0 | 50:50 | 100:0 | PPS2 not contained |
| Comparative Example 1 | 0:70:30 | 0:100 | 70:30 | CF not contained |
| Comparative Example 2 | 0:30:70 | 0:100 | 30:70 | CF not contained |
| Comparative Example 3 | 20:80:0 | 20:80 | 100:0 | PPS2 not contained |
| Comparative Example 4 | 50:50:0 | 50:50 | 100:0 | PPS2 not contained |
| Comparative Example 5 | 80:20:0 | 80:20 | 100:0 | PPS2 not contained |

In Table 1, CF represents cellulose fiber; PPS1 represents stretched PPS fiber; and PPS2 represents unstretched PPS fiber. In Table 1, furthermore, CF:PPS1:PPS2 represents the mass ratio among the fiber components constituting the sheet; CF:(PPS1+PPS2) represents the mass ratio between the cellulose fiber and the PPS fiber (sum of the stretched PPS fiber and the unstretched PPS fiber) constituting the sheet; and PPS1:PPS2 represents the mass ratio between the stretched PPS fiber and the unstretched PPS contained in the sheet.

Then, evaluation of the sheets prepared in Examples given above was carried out.

Measurement and Evaluation Methods

The following methods were used for the measurement and evaluation of various characteristics.

(1) Mass Per Unit Area

According to JIS L 1906 (2000), a test piece of 25 cm×25 cm was sampled and its mass (g) in the standard state was measured and converted into the mass per m$^2$ (g/m$^2$).

(2) Thickness

According to JIS L 1096 (1999), which was used mutatis mutandis as JIS L 1906 (2000), using a thickness gauge, a pressure of 2 kPa was applied with an indenter with a diameter of 22 mm and the thickness was measured after waiting for 10 seconds to ensure a steady state. Measurements were taken at 10 different positions in the specimen and their average was calculated.

(3) Tensile Strength

According to JIS P 8113 (2006), a test piece with a width of 15 mm and length of 180 mm was subjected to tensile strength (a) measurement at tension speed 200 mm/min using a tensile tester (AGS-J5kN, manufactured by Shimadzu Corporation). Test pieces were sampled such that the length direction of each test piece coincided with the vertical direction of the sheet.

(4a) Strength Retention Rate 1 (Strength Retention Rate at Service Environment Temperature)

A sheet was heat-treated by leaving it at a temperature of 200° C. for 4.5 hours in a hot air circulating type drying machine and its tensile strength (b) was measured after taking it out of the drying machine, followed by calculating its strength retention rate by the equation given below. Tensile strength measurement was carried out according to JIS P 8113 (2006) for a test piece with a width of 15 mm and length of 180 mm at tension speed 200 mm/min using a tensile tester (AGS-J5kN, manufactured by Shimadzu Corporation). Test pieces were sampled such that the length direction of each test piece coincided with the vertical direction of the sheet.

$$\text{Strength retention rate (\%)}=b/a\times100$$

(4b) Strength Retention Rate 2 (Strength Retention Rate at Overshoot Temperature)

A sheet was put between a metal roll heated at 230° C. and a silicon rubber roll and the metal roll was pressed against it for a minute with a pressure of 0.1 kgf/cm$^2$. Then the tensile strength (c) was measured while maintaining the pressure, and the strength retention rate was calculated by the following equation. Tensile strength measurement was carried out according to JIS P 8113 (2006) for a test piece with a width of 15 mm and length of 180 mm at tension speed 200 mm/min using a tensile tester (AGS-J5kN, manufactured by Shimadzu Corporation). Test pieces were sampled such that the length direction of each test piece coincided with the vertical direction of the sheet.

$$\text{Strength retention rate (\%)}=c/a\times100$$

(5) Dry Heat Shrinkage Rate

A test piece with a length of 200 mm and a width of 200 mm cut out of a sheet was heat-treated by leaving it at a temperature of 200° C. for 15 minutes in a hot air circulating type drying machine and its width (d) was measured in millimeter after taking it out of the drying machine, followed by calculating the dry heat shrinkage rate by the equation given below.

$$\text{Dry heat shrinkage rate (\%)}=(200-d)/200\times100$$

(6) Cleaning performance

Silicone oil (KF-965-10000cs, manufactured by Shin-Etsu Chemical Co., Ltd.) was spread at a rate of 5 g/m$^2$ over the surface of a sheet, which was then installed as toner cleaning sheet in a commercial copying machine (manufactured by Fuji Xerox Co., Ltd.), followed by copying a solid black image 50 times. Subsequently, the sheet was taken out and the density of the toner-carrying surface observed visually and evaluated in five ranks (rank 1 to rank 5) according to the gray scale for contamination evaluation specified in JIS L 0805 (2005). Sheets with lower rank numbers exhibited better cleaning performance results. Sheets having results better than rank 1 density were included in the rank 1 group. The toner used was CT200564 manufactured by Fuji Xerox Co., Ltd.

(7) Existence of Fusion Bonding in Sheet Surface

A test piece was observed at a magnification of 300 using a scanning electron microscope (S-3500N, manufactured by Hitachi High-Technologies Corporation) and it was regarded as having undergone fusion bonding if there was at least one part where two neighboring fibrous clusters had lost distinct boundaries in a 0.14 mm$^2$ area of the test piece that was able to be observed in a field of view. The results were represent as "yes" if fusion bonding existed and "no" if no fusion bonding existed. Observed above was the sheet surface that was in contact with the metal roll when the sheet was heated under pressure.

(8) Melting Point

A fiber sample of about 2 mg was weighed out and enclosed in an aluminum pan with an airtight pan cover and measurements were taken by a differential scanning calorimeter (DSC-60, manufactured by Shimadzu Corporation). For the measurement, a sample was heated in a nitrogen atmosphere from 20° C. to 320° C. at a heating rate of 10° C./min and then quenched with liquid nitrogen, followed by heating again in a nitrogen atmosphere from 20° C. to 320° C. at a heating rate of 10° C./min. The temperature of the main endothermic peak observed during the second heating run was determined and adopted as melting point.

Evaluation results from the sheets prepared in Examples and Comparative examples are summarized in Tables 2 and 3 given below.

TABLE 2

Evaluation results 1

| | Mass per unit area (g/m$^2$) | Thickness (mm) | Tensile strength (Mpa) | Strength retention rate 1 (%) | Strength retention rate 2 (%) |
|---|---|---|---|---|---|
| Example 1 | 21 | 30 | 53 | 83 | 44 |
| Example 2 | 21 | 30 | 52 | 80 | 32 |
| Example 3 | 21 | 29 | 54 | 83 | 32 |
| Example 4 | 20 | 30 | 57 | 60 | 52 |
| Example 5 | 20 | 30 | 59 | 58 | 45 |
| Example 6 | 20 | 29 | 60 | 64 | 40 |
| Example 7 | 19 | 29 | 66 | 22 | 57 |
| Example 8 | 20 | 29 | 68 | 20 | 51 |
| Example 9 | 20 | 29 | 68 | 21 | 41 |
| Example 10 | 22 | 32 | 52 | 78 | 55 |
| Comparative Example 1 | 21 | 30 | 43 | 108 | 15 |
| Comparative Example 2 | 21 | 29 | 49 | 98 | 14 |
| Comparative Example 3 | 20 | 30 | 48 | 18 | 35 |
| Comparative Example 4 | 19 | 29 | 56 | 15 | 49 |
| Comparative Example 5 | 20 | 29 | 64 | 16 | 76 |

TABLE 3

Evaluation results 2

| | Dry heat shrinkage rate (%) | Cleaning performance (rank) | Existence of fusion bonding in surface |
|---|---|---|---|
| Example 1 | 2 | 1 | yes |
| Example 2 | 3 | 1 | yes |
| Example 3 | 4 | 1 | yes |

TABLE 3-continued

| Evaluation results 2 | | | |
|---|---|---|---|
| | Dry heat shrinkage rate (%) | Cleaning performance (rank) | Existence of fusion bonding in surface |
| Example 4 | 1 | 1 | yes |
| Example 5 | 1 | 1 | yes |
| Example 6 | 1 | 1 | yes |
| Example 7 | 0.5 | 1 | yes |
| Example 8 | 0.5 | 1 | yes |
| Example 9 | 0.5 | 1 | yes |
| Example 10 | 0.5 | 2 | yes |
| Comparative Example 1 | 5 | 1 | yes |
| Comparative Example 2 | 6 | 1 | yes |
| Comparative Example 3 | 2 | 4 | no |
| Comparative Example 4 | 1 | 3 | no |
| Comparative Example 5 | 0.5 | 3 | no |

As seen clearly from the results in Tables 2 and 3, the toner cleaning sheets obtained in the Examples had better toner cleaning performance and higher heat resistance than the sheets obtained in the Comparative Examples. We also found that the use of cellulose fiber, which is high in availability and low in price, ensures low-cost, stable supply.

Compared to this, the sheets obtained in Comparative Examples 1 to 2, which did not contain cellulose fiber, were low in strength retention rate at the time of overshoot and in addition high in heat shrinkage and narrow in cleaning range, and consequently they failed to have required quality for practical applications.

In the sheets obtained in Comparative Examples 3 to 5, furthermore, fusion bonding of thermoplastic fiber did not occur and the contact area with the fixing roll, which was assumed to work as an object to be cleaned, was small, leading to poor cleaning performance.

The invention claimed is:

1. A toner cleaning sheet comprising at least one kind of the thermoplastic fiber selected from polyphenylene sulfide fiber, polytetrafluoroethylene fiber, ethylene-tetrafluoroethylene copolymer fiber, liquid crystal polyester fiber, polyethylene naphthalate fiber, polyether ether ketone fiber and triacetate fiber, and at least one kind of fiber selected from among different cellulose fibers, wherein at least part of the thermoplastic fiber is fused and bonded to neighboring thermoplastic fiber filaments.

2. The toner cleaning sheet as claimed in claim 1, wherein the cellulose fiber is wood pulp fiber.

3. The toner cleaning sheet as claimed in claim 2, wherein the thermoplastic fiber contains both stretched filaments and unstretched filaments.

4. The toner cleaning sheet as claimed in claim 2, wherein a ratio between the at least one kind of fiber selected from among different thermoplastic fibers and the at least one kind of fiber selected from among different cellulose fibers is 8:2 to 2:8 by mass.

5. The toner cleaning sheet as claimed in claim 1, wherein the thermoplastic fiber contains both stretched filaments and unstretched filaments.

6. The toner cleaning sheet as claimed in claim 5, wherein the stretched filaments are stretched polyphenylene sulfide filaments and the unstretched filaments are unstretched polyphenylene sulfide filaments.

7. The toner cleaning sheet as claimed in claim 6, wherein a ratio between the at least one kind of fiber selected from among different thermoplastic fibers and the at least one kind of fiber selected from among different cellulose fibers is 8:2 to 2:8 by mass.

8. The toner cleaning sheet as claimed in claim 5, wherein a ratio between the at least one kind of fiber selected from among different thermoplastic fibers and the at least one kind of fiber selected from among different cellulose fibers is 8:2 to 2:8 by mass.

9. The toner cleaning sheet as claimed in claim 1, wherein a ratio between the at least one kind of fiber selected from among different thermoplastic fibers and the at least one kind of fiber selected from among different cellulose fibers is 8:2 to 2:8 by mass.

10. The toner cleaning sheet as claimed in claim 9, wherein a ratio between the stretched polyphenylene sulfide filaments and the unstretched polyphenylene sulfide filaments is 7:3 to 3:7 by mass.

* * * * *